US006523214B1

(12) United States Patent
Kaiser

(10) Patent No.: US 6,523,214 B1
(45) Date of Patent: Feb. 25, 2003

(54) QUICK MOUNT ATTACHMENT FOR ROTARY FINISHING TOOL

(76) Inventor: Richard A. Kaiser, N84 W28518 Center Oak Rd., Hartland, WI (US) 53029

( * ) Notice: Subject to any disclaimer, the term of this patent is extended or adjusted under 35 U.S.C. 154(b) by 297 days.

(21) Appl. No.: 09/593,427

(22) Filed: Jun. 14, 2000

(51) Int. Cl.[7] ..... A47L 11/14; A47L 11/40

(52) U.S. Cl. ..... 15/230; 15/28; 15/97.1; 15/180; 451/359; 451/515; 451/519

(58) Field of Search ..... 15/28, 97.1, 180, 15/230, 230.17, 230.19; 451/353, 359, 490, 514, 516, 519

(56) References Cited

U.S. PATENT DOCUMENTS

| | | | | | |
|---|---|---|---|---|---|
| 897,286 | A | * | 9/1908 | Haskell | 15/97.1 X |
| 1,417,593 | A | * | 5/1922 | Christine | 15/230 X |
| 1,610,658 | A | * | 12/1926 | Christie | 15/230.19 |
| 1,881,431 | A | * | 10/1932 | Finnell | 15/230 X |
| 1,881,432 | A | * | 10/1932 | Finnell | 15/180 |
| 1,979,527 | A | * | 11/1934 | Bissell | 15/230.19 |
| 2,111,955 | A | * | 3/1938 | Akans | 451/516 |
| 2,173,350 | A | * | 9/1939 | Bissell | 15/230 X |
| 2,550,768 | A | * | 5/1951 | Burleigh | 451/359 X |
| 2,561,279 | A | * | 7/1951 | Holt | 15/180 X |
| 2,671,994 | A | | 3/1954 | Hickman | 451/508 |
| 3,162,876 | A | * | 12/1964 | Aronson, II et al. | 15/28 |
| 3,243,833 | A | * | 4/1966 | Hencken | 15/230.19 X |
| 3,270,467 | A | | 9/1966 | Block et al. | 451/509 |
| 3,376,675 | A | * | 4/1968 | Hutchins | 15/230 X |
| 3,562,843 | A | * | 2/1971 | Belicka et al. | 15/180 |
| 3,623,281 | A | | 11/1971 | Moffat | 451/509 |
| 4,907,313 | A | | 3/1990 | Roeker et al. | 15/98 |
| 4,924,636 | A | * | 5/1990 | Hoffman | 15/180 X |
| 5,138,735 | A | | 8/1992 | Kusz et al. | 15/97.1 |
| 5,243,727 | A | * | 9/1993 | Tanaka et al. | 15/180 X |
| 5,259,085 | A | | 11/1993 | Marafante et al. | 15/98 |
| 5,421,053 | A | * | 6/1995 | Chodak | 15/180 X |
| 5,964,006 | A | | 10/1999 | Holmes et al. | 15/180 |
| 6,179,697 | B1 | | 1/2001 | Shibai | 451/359 |

FOREIGN PATENT DOCUMENTS

| | | | | |
|---|---|---|---|---|
| AT | 128152 | * | 11/1946 | 15/97.1 |
| DE | 1 037 914 | | 8/1958 | |
| DE | 199 12 001 | | 9/1999 | |
| EP | 0 487 892 | | 6/1992 | |
| GB | 281309 | * | 3/1928 | 15/180 |
| IT | 450523 | * | 7/1949 | 15/180 |

* cited by examiner

*Primary Examiner*—Mark Spisich
(74) *Attorney, Agent, or Firm*—Andrus, Sceales, Starke & Sawall

(57) ABSTRACT

A rotary finishing tool, such as a buffing pad, utilizes a connector assembly for demountable attachment to a powered rotary backing plate. The finishing tool is attached to the front face of a backing disc and the rear face of the backing disc includes a first piece of the connector assembly, the second piece of which is carried by the backing plate. The first and second connector pieces include complementary driving surfaces and complementary locking surfaces which respectively interengage in response to linear movement bringing the two connector pieces together and relative radial movement between the locking surfaces which are preferably resiliently biased.

9 Claims, 5 Drawing Sheets

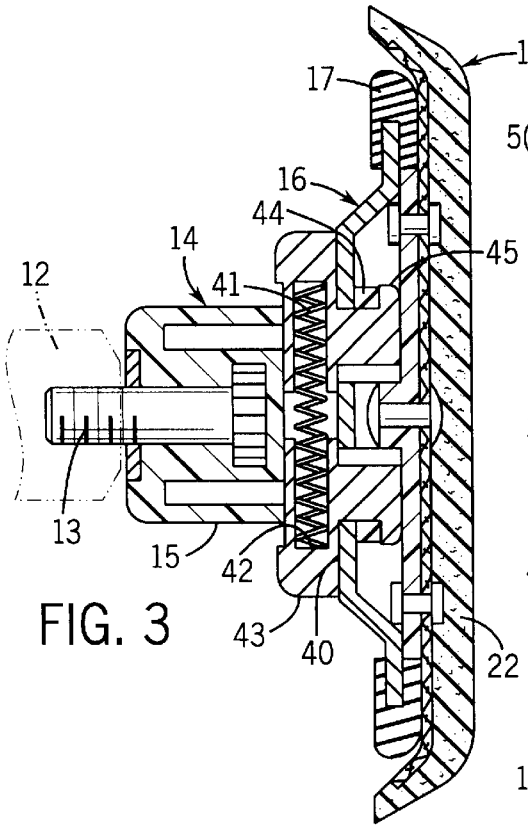
FIG. 3
FIG. 5
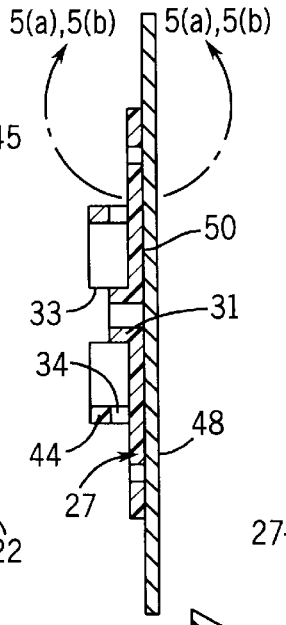
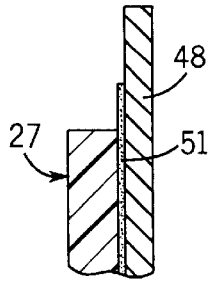
FIG. 5(a)
FIG. 5(b)
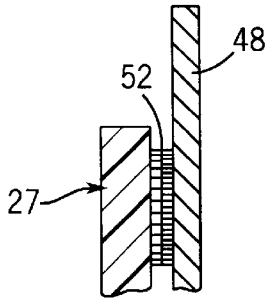
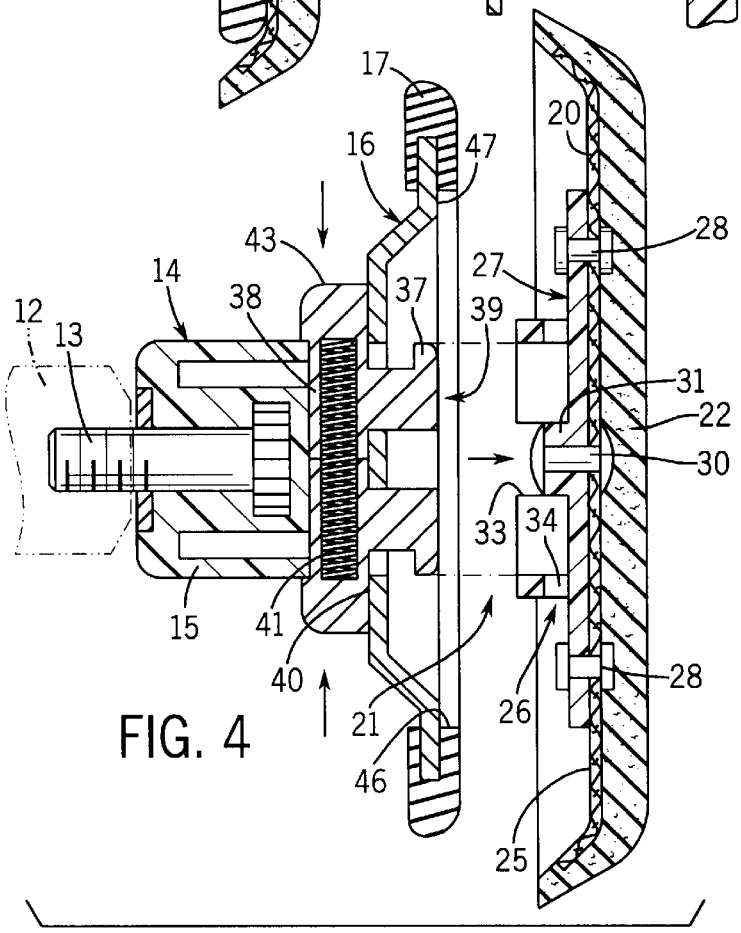
FIG. 4

FIG. 6
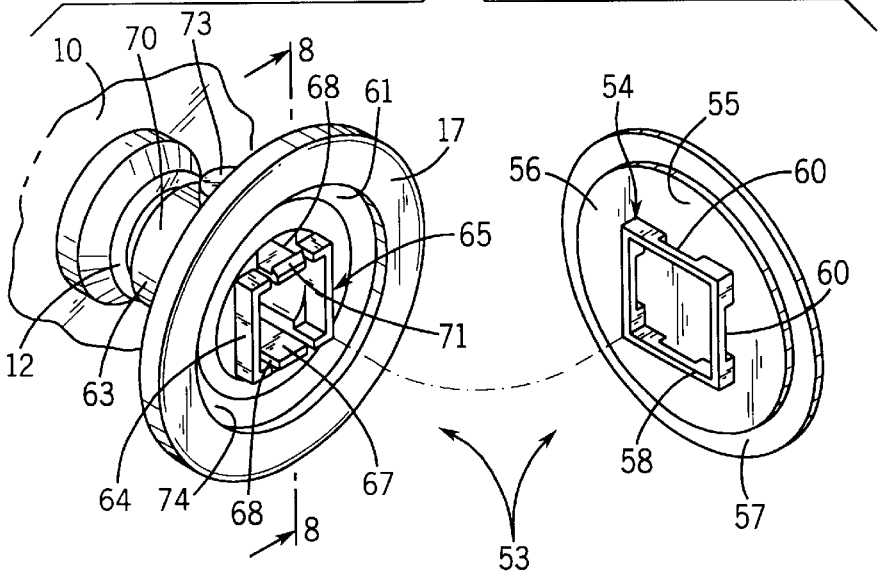
FIG. 8
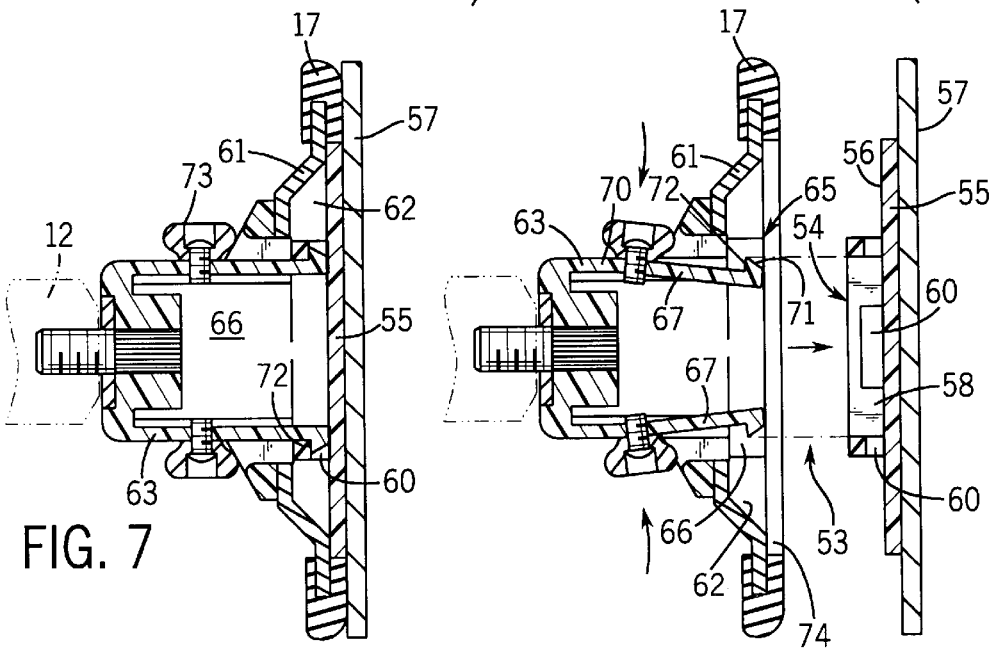
FIG. 7

FIG. 9
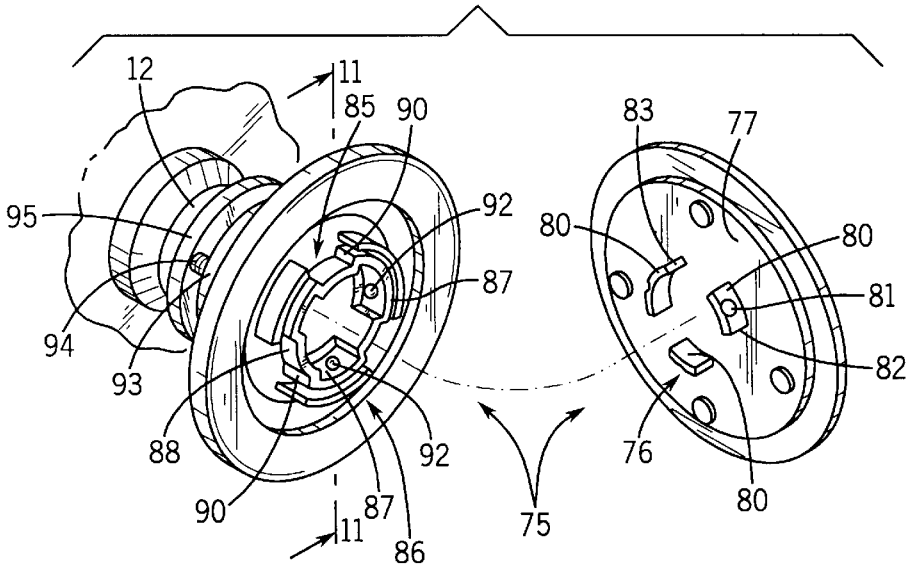
FIG. 11
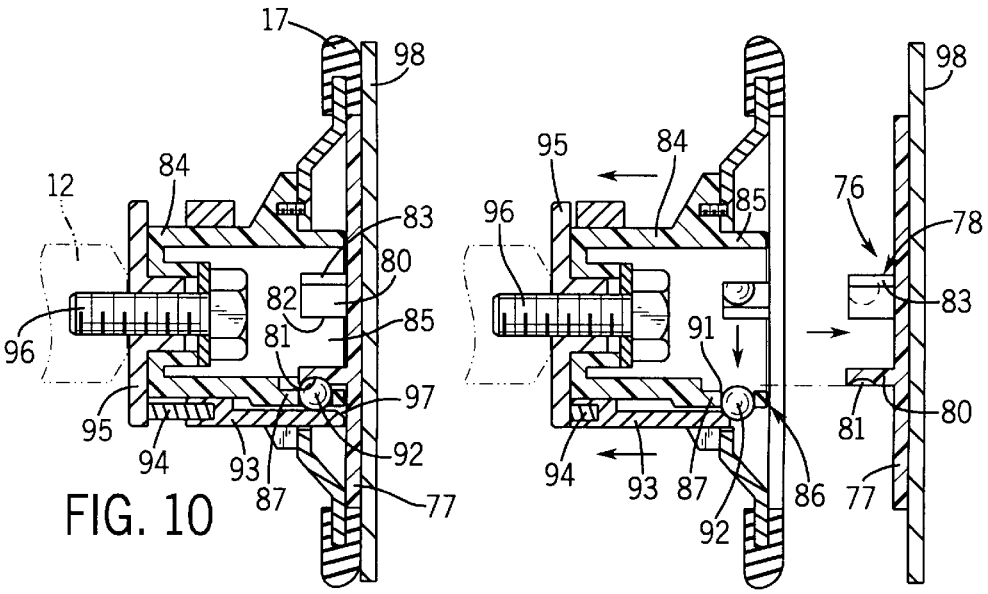
FIG. 10

QUICK MOUNT ATTACHMENT FOR ROTARY FINISHING TOOL

BACKGROUND OF THE INVENTION

The present invention relates to surface finishing tools, such as are used for sanding, buffing, and polishing, and more particularly, to a system for easily and quickly attaching and removing a rotary finishing tool from the rotary power device used to drive the tool.

Rotary surface finishing tools, used to provide a wide variety of surface finishing functions including sanding, buffing, and polishing, are well known in the art. As used herein, the term "rotary" is meant to include orbitally driven finishing tools which, in most delicate finishing operations, are preferred because of the reduction in swirl marks in the finish on the workpiece. Such tools are typically circular in shape and are mounted on the drive spindle or arbor of a powered rotary or orbital driver which is held and manipulated by an operator. A wide variety of finishing tool mounting devices are known in the prior art, but one particularly desirable characteristic is to provide an assembly whereby the finishing tool may be quickly and easily mounted and removed from the power driver so that the operator can change tools with a minimum loss of time and with minimum effort. It is also important that a mounting system accurately center the rotary finishing tool on the axis of the power driver to maintain balance for high speed operation. It is also important to maintain positive driving contact between the driver and the finishing tool to avoid tool slippage and unbalance.

U.S. Pat. No. 4,907,313 shows a buffing pad attached to a cushioned back-up plate with the back-up plate attached directly to the drive spindle of a rotary driver. The pad and back-up plate are designed to provide self-centering attachment and actual attachment is provided by complimentary hook and loop fasteners on engaging surfaces of the pad and the back-up plate. Hook and loop fastener systems are widely used to attach rotary buffing pads, including dual action pads which combine rotary and orbital motion. Both types suffer from a common problem of fastener degradation as a result of heat buildup in the pad during operation. This can cause the pad to slip and move to an unbalanced off centered position or to even detach from the backing plate. Hook and loop fasteners are also known to degrade with washing and present a problem for pads intended to cleaning and reuse.

Another approach to attaching a rotary finishing tool to the drive spindle of a rotary operator is shown in U.S. Pat. No. 5,964,006. This attachment device uses an attachment nut that is threaded onto the shaft of the drive spindle, is automatically self-centering, and includes drive lugs on the pad which are engaged by the nut to help in attaching the pad and to drive the pad. The disadvantages of this assembly include the attachment nut which is exposed on the operating face of the pad and the need to thread and unthread the nut to mount and remove the finishing pad.

U.S. Pat. No. 5,138,735 shows a rotary buffing pad attachment device in which the pad has an internally threaded hub that is threadably attached to a complimentary externally threaded hub on the backing plate. The pad may be removed from the backing plate either by unthreading it or by utilizing the inherent resilience of the threaded plate hub to simply pull the buffing pad from threaded engagement with the hub. However, because the pad attachment to the hub is not positively locked, the pad may be inadvertently pulled off the hub if an obstruction is encountered in use. In addition, the pad attachment assembly requires complete threaded engagement to mount the pad and the use of a completely non-standard backing plate construction for the finishing pad.

SUMMARY OF THE INVENTION

In accordance with the present invention, an assembly for demountably attaching a rotary finishing pad or similar rotary finishing tool to the rotary drive spindle of a power tool includes a backing disc having a front face to which the rotary finishing tool is attached, either permanently or demountably, and a rear face that incorporates a first connector piece of a connector assembly for demountably attaching the backing disc to the front face of an annular backing plate. The backing plate, in turn, includes a drive hub that is adapted for driven connection to the drive spindle of a power tool. The front face of the backing plate includes a second connector piece for quick demountable attachment to the first connector piece on the rear face of the backing disc. The first and second connector pieces have complementary driving surfaces and complementary locking surfaces which respectively interengage in response to relative linear movement along their rotational axes of the backing disc into engagement with the backing plate, and relative radial movement between the locking surfaces with respect to said axes.

In the preferred embodiment, the backing disc has a circular outer peripheral edge and the backing plate has an annular ring of cushioning material attached to its outer peripheral edge, which ring of cushioning material has an inner peripheral edge that defines with the backing plate an annular recess dimensioned to receive the backing disc. The rotary finishing tool comprises a flexible circular disc having a generally flat rear face that is attached to the front face of the backing disc and, by virtue of the backing disc being recessed in the backing plate, the outer edge of the finishing tool extends radially outwardly into contact with the cushioning ring.

The locking surfaces on one of the two connector pieces are preferably deflectable in a radial direction with respect to the rotational axes to an unlocking position. In addition, the locking surfaces may be resiliently biased in an opposite radial direction to a locked position.

Preferably, the first connector piece comprises an integral unitary extension of the backing disc. In one embodiment, the first connector piece comprises a sleeve having its center axis coaxial with the backing disc and a plurality of oppositely disposed locking openings in said sleeve. In this embodiment, the second connector piece comprises a plurality of oppositely disposed locking projections that are resiliently biased into the locking openings in the sleeve and are manually retractable against said resilient bias from the locking openings. Preferably, the sleeve is annular in shape, and includes a pair of diametrically opposite driving slots positioned circumferentially spaced from the locking openings, and the second connector piece includes a pair of diametrically opposite driving projections circumferentially positioned to lie in and to engage said driving slots when the locking projections are aligned with the locking openings.

In another embodiment, the first connector piece sleeve is non-circular in shape, and the second connector piece comprises a frame piece having a non-circular shape and dimensioned to fit within said sleeve, the sleeve and the frame piece having abutting surfaces which form the driving surfaces.

In further embodiment, the sleeve on the rear face of the backing disc comprises a plurality of circumferentially spaced cylindrical first wall sections having inner and outer wall faces, each first wall section having a locking opening in one wall face and a first edge face between said wall faces, and said connector piece comprises a plurality of cylindrical second wall sections adapted to coaxially receive said first wall sections, each second wall section including an opposing wall face carrying one of said locking projections and a second edge face providing with said first edge face the driving surfaces. The locking openings in the first wall sections preferably comprise spherical recesses and the locking projections carried in the second wall sections comprise complementary spherical balls. The spherical recesses are preferably formed in the outer wall faces of said first wall sections and the spherical balls are mounted in retaining holes in said second walls sections for radial movement into locking engagement with said spherical recesses.

BRIEF DESCRIPTION OF THE DRAWINGS

FIGS. 3 and 4 are sectional views taken on line 4—4 of FIG. 2 showing, respectively, the connected and disconnected positions of the assembly.

FIG. 5 is a sectional view through the backing disc of the embodiment in FIGS. 2–4.

FIGS. 5(*a*) and 5(*b*) are sectional details of a portion of FIG. 5 showing alternate arrangements for attaching a rotary finishing tool to the backing disc.

FIG. 6 is an exploded perspective view, similar to FIG. 2, showing another embodiment of the invention.

FIGS. 7 and 8 are sectional views taken on line 8—8 of FIG. 6 showing, respectively, the connected and disconnected positions of the connector assembly of this alternate embodiment.

FIG. 9 is an exploded perspective view a further embodiment of the invention.

FIGS. 10 and 11 are sectional views taken on line 11—11 of FIG. 9 and showing, respectively, the connected and disconnected positions of the connector assembly of this embodiment.

DETAILED DESCRIPTION OF THE PREFERRED EMBODIMENTS

Figure 1:
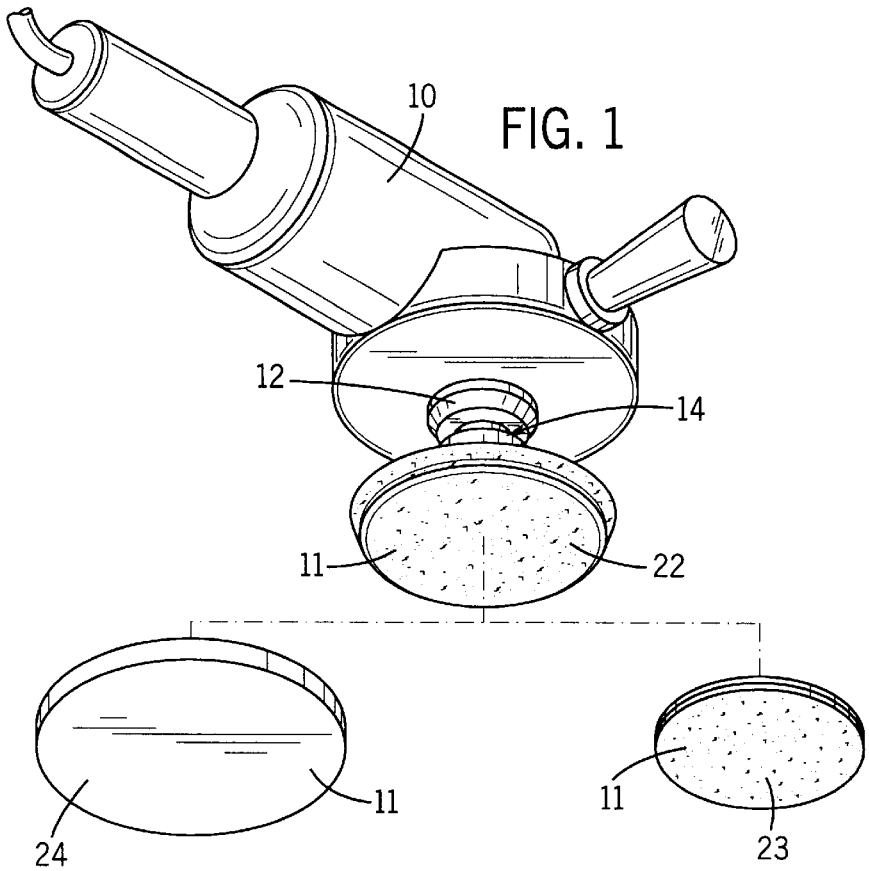
FIG. 1 is a perspective general arrangement view of the rotary drive tool to which various types of rotary finishing pads may be attached using the mounting assembly of the present invention.

A conventional rotary power tool 10 of the type typically used to mount and drive a rotary finishing tool 11 is shown in FIG. 1. This type of rotary power tool 10 or rotary driver is typically either pneumatically or electrically powered and held by an operator in both hands for finishing a surface, such as a painted surface of an automobile body. The power tool includes a rotary or orbital drive spindle 12 which may simply be tapped to receive a threaded stud 13 attached to a drive hub 14 as shown in FIGS. 3 and 4, which is typical for orbital tools. The drive hub 14 includes a hub body 15 that carries the threaded stud 13 and an annular backing plate 16 which may be formed integrally with the hub body or may be formed of a separate piece. Alternately, the drive spindle may carry a threaded stud that connects to a tapped drive hub (not shown in the drawings). In all of the embodiments described herein, the backing plate has an annular cushioning ring 17 attached to the outer peripheral edge. The front face 18 of the backing plate 16 is demountably attached to the rear face 20 of the rotary finishing tool 11 utilizing the connector assembly 21 of the present invention.

Figure 2:
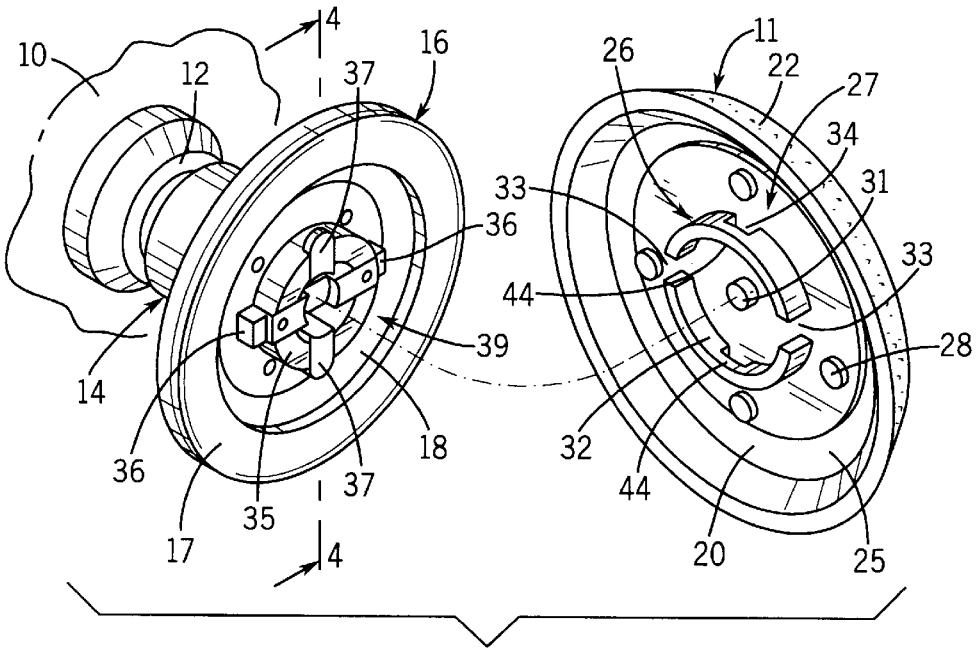
FIG. 2 is an exploded perspective view of the presently preferred embodiment of the connector assembly of the present invention.

Referring also to FIG. 2, the rotary finishing tool 11 may comprise a conventional foam buffing pad 22 made, for example, of open cell polyurethane foam. However, the connector assembly of the present invention may be used as well to demountably attach other finishing tools, such as a conventional tufted wool pad 23 (see FIG. 1) or a circular sheet of sandpaper 24, as well as other finishing materials well known in the art. The foam buffing pad 22 is made with a backing layer 25 of stiff but flexible material to hold the outer peripheral edge of the pad turned upwardly to form a dish-shape.

The connector assembly 21 includes a first connector piece 26 formed as an integral rearward extension of a backing disc 27. In the embodiment of FIGS. 2–4, the backing disc 27 is formed of a rigid plastic material and is secured to the foam buffing pad 22 with a circular pattern of rivets 28 extending through the backing layer 25 and mounting holes in the backing disc. Optionally, a center rivet 30 may also be utilized that extends through the backing layer is secured in a small center post 31 on the backing disc 27. In another variation, the outer pattern of rivets 28 may be replaced by a pattern of pegs formed integrally with the backing disc 27 and engaging holes in the backing layer 25 of the pad. The engagement of the pegs in the holes provides the rotary drive transmission and the center rivet 30 provides the positive connection.

As indicated, the rear face of the backing disc 27 includes a first connector piece 26 in the form of an annular sleeve 32. The sleeve 32 is interrupted by a pair of diametrically opposite drive slots 33 and a pair of diametrically opposite locking openings 34 positioned transverse to the drive slots.

The backing plate 16 includes a center hub extension 35 carrying a second connector piece 39 that includes a pair of diametrically opposite drive lugs 36 in a fixed position, and a pair of diametrically opposite locking projections mounted to be manually retracted to an unlocking position and spring biased to move when released to a locking position. The locking projections 37 are carried on locking slides 38 that slide in tracking slots 40 formed in the hub body 15. The locking slides 38 are positioned back-to-back in the tracking slots 40 and are biased in opposite directions by a common compression spring 41 having its opposite ends seated in recesses 42 in the slides 38. The locking slides extend to the outside of the hub body and are provided with manually engageable buttons 43 which, when squeezed together as by the thumb and finger of the operator, compress the spring 41 and cause the locking projections 37 to move linearly toward one another. Thus, when the sleeve 32 on the first connector piece 26 is brought into contact with the second connector piece 39, aligned axially with the hub extension 35, and rotated until the drive lugs 36 are aligned with the drive slots 33, the buttons 43 may be squeezed to retract the locking projections 37 allowing the projections to pass the upper edges 44 of the locking openings 34, after which the buttons may be released thereby allowing the projections 37 to enter the openings 34 to hold the buffing pad against axial displacement from the backing plate. Simultaneously, the drive lugs 36 enter the drive slots 33 where their complementary side surfaces engage to help transmit rotational drive force from the drive hub 14 to the buffing pad 22. It should be noted that it is possible to eliminate the drive lugs 36 and to utilize side edge contact between the locking projections 37 and the side surfaces of the locking openings 34 to provide the transmission of rotary driving force. However, it is preferred to use the additional drive lugs and drive slots to provide a better and more reliable rotary load transfer.

When it is desired to change the buffing pad, either because it has become loaded with finishing compound, excessively worn, or simply to replace it with another type of pad, the operator simply squeezes the slide buttons 43 together, thereby withdrawing the locking projections 37 from the locking openings 34 and allowing the pad 22 to be pulled away from the backing plate. To assist in pad attachment or reattachment, the noses 45 of the locking projections 37 may be rounded to provide a lead in, facilitating passage of projections past the upper edges 44 of the locking openings. Indeed, the noses 45 of the locking projections may be suitably shaped and sized to allow deflection of the projections toward one another and compression of the spring 41 merely in response to forcing the backing disc sleeve 32 against the locking projections.

As indicated previously, an annular cushioning ring 17 is attached to the outer peripheral edge of the backing plate 16. As may best be seen in FIGS. 2 and 4, the cushioning ring 17 has a U-shaped cross section allowing it to be stretched slightly and to fit snuggly around the backing plate peripheral edge. The inner edge 46 of the cushioning ring 17 on the front face 18 of the backing plate defines, with the backing plate, shallow recess 47 sized to receive the backing disc 27 as the connector assembly is engaged. This, in turn, allows the rear face 20 of the buffing pad 22 to engage the cushioning ring 17. When operating the tool in one common mode wherein the pad is tilted and the dished edge of the pad 22 is brought into contact with the workpiece, the cushioning ring 17 provides a soft and resilient backing for the rapidly rotating buffing pad edge.

In the preferred embodiment just described, the backing disc 27 is permanently attached to the buffing pad 22 with rivets 28. For example, the rivets 28 could be replaced by screws, making the backing disc reusable. Other means for attaching a buffing pad or a different type of rotary finishing tool may also be utilized in conjunction with the same or a similar backing disc 27 to allow use of the same connector assembly 21. In FIG. 5, a piece of sandpaper 48 is permanently affixed to the front face 50 of the backing disc 27. As previously described, the backing disc seats in the shallow recess 47 formed on the interior of the cushioning ring 17 after connection is completed, and the outer peripheral edges of the sandpaper disc 48 are supported against the cushioning ring 17. In FIG. 5(*a*), a flexible sheet of sandpaper 48 or other abrasive material is attached to the front face 50 of the backing disc 27 with a self-sticking adhesive layer 51. In FIG. 5(*b*), the sandpaper sheet 48 is demountably attached to the backing disc 27 with a complementary hook and loop fastening pair 52. Although the demountable attachments in FIGS. 5(*a*) and 5(*b*) are described with respect to the mounting of a sandpaper sheet, it is understood that other types of finishing tools, such as buffing pads could also be mounted in this way. However, as previously discussed, positive drive characteristics of the connector asssembly 21 of the present invention is intended to eliminate the problem of heat degradation and loss of connection that might occur with a hook and loop fastening system. Thus, permanent connection between the backing disc 27 and the rotary finishing tool is preferred.

FIGS. 6 through 8 show a first alternate embodiment of a connector assembly 53. As in the previously described preferred embodiment, the connector assembly 53 includes a first connector piece 54 formed as an integral rearward projection from the rear face 56 of a backing disc 55. The front face of the backing disc 55 carries a permanently attached finishing disc 57, but it could as well be a buffing pad or other type of rotary finishing tool. The first connector piece 54 is a square sleeve 58 in the lower edge of each side of which is formed a locking opening 60. A drive hub 63 mounted on a rotary power tool 10 carries a backing plate 61, from the front face 62 of which protrudes a center hub extension 64 that forms the second connector piece 65 of the connector assembly 53. The hub extension 64 includes a square frame piece 66 that is dimensioned to fit within the square sleeve 58 on the backside of the backing disc 55. Two opposite sides of the frame piece 66, which is preferably formed of a resilient plastic material, are cut along parallel longitudinal edges 68 to form a pair of locking tabs 67. The upper ends of the locking tabs 67 remain connected to the hub body 70 in a manner allowing the tabs to be flexed toward and away from one another. The free edges of the tabs 67 are provided with tapered lead-in surfaces 71 which terminate in locking shoulders 72. As the square frame piece 66 is inserted axially into the square sleeve 58 and the free ends of the locking tabs 67 are deflected toward one another, the shoulders 72 on the free edges of the tabs will align with the locking openings 60, allowing the locking tabs to spring back to their free state with the locking shoulders 72 engaging the upper edges of opposite locking openings 60. To assist in making the connection, as by moving the drive hub 63 axially into contact with the backing disc 55 (from the FIG. 8 position to the FIG. 7 locked position), the locking tabs 67 on their attached upper ends may be provided with buttons 73 that are engaged and squeezed together by a thumb and finger of the operator, thereby deflecting the free ends of the tabs radially inwardly to facilitate passage into the square sleeve 58. Alternately or in addition to the manual compression buttons 73, the lead-in surfaces 71 may be sized and shaped to allow the tabs 67 to be deflected merely by axial movement in the direction of the axial arrow in FIG. 8.

As with the previously described embodiment, the backing plate 61 is provided with a cushioning ring 17 which, with the backing plate, defines a shallow recess 74 to receive the backing disc 55. The outer peripheral edge of the flexible finishing disc 57 may then contact and be resiliently biased against the cushioning ring during use. Contact between the adjoining faces of the square sleeve 58 and square frame piece 66 provide ample bearing surface for transmitting rotational drive load from the drive hub 63 to finishing disc 57. It will be appreciated that the sleeve 58 and interengaging frame piece 66 may be of other than a square shape, such as hexagonal or octagonal, or even oval.

Referring to FIGS. 9–11, there is shown a second alternate embodiment of a connector assembly 75 in accordance with the present invention. In this embodiment, a first connector piece 76 is formed as an integral rearward extension of a backing disc 77. The connector piece 76 is in the shape of a sleeve 78 which is slotted to define three circumferentially spaced cylindrical first wall sections 80. The radial outer face of each wall section 80 is provided with a spherical recess 81. The lateral edges 82 of each wall section 80 define first edge faces 83. A drive hub 84, connected as previously described to a drive spindle 12 of a rotary power tool, includes a center hub extension 85 that defines a second connector piece 86 adapted to engage and be attached to the first connector piece 76 on the backing disc 77. The second connector piece comprises a generally cylindrical sleeve defined by three circumferentially spaced cylindrical wall sections 87 connected by intermediate cylindrical web sections 88. The cylindrical wall sections 87 are dimensioned to receive the first wall sections 80 of the backing disc while the cylindrical web sections 88 fit between the wall sections 80 such that the web section edge faces 90 engage the edge faces 83 on the first wall sections 80. Each of the cylindrical wall sections 87 on the second connector piece 86 is provided with a spherical opening 91 sized to receive a spherical ball 92, such as a steel bearing ball, inserted from the radial outer side of the wall section 87 to protrude through the radial inner face of the wall section without passing therethrough. An outer retaining sleeve 93 surrounds the hub extension and retains the spherical balls 92 within the openings 91. The retaining sleeve 93 surrounds the drive hub 84 and is biased axially downwardly along the hub body by a series of small compression springs 94 captured by one end in counterbores in the upper edge of the retaining sleeve 93 and by their opposites which bear against a retaining plate 95 connected to the threaded drive stud 96.

Referring to FIG. 11, when the retaining sleeve 93 is grasped by the operator and slid manually against the force of the compression springs 94 in the direction of the outer pair of arrows, the spherical balls 92 will retract slightly in an outward radial direction in the spherical openings 91. However, the sleeve 93 is dimensioned so that its chamfered lower edge 97 will maintain engagement with the balls 92, thereby preventing them from falling from the spherical openings 91. In the FIG. 11 position, the drive hub 84 is moved axially into contact with the backing disc 77 and, when the ends of the cylindrical wall sections 87 engage the back face of the backing disc 77, release of the retaining sleeve 93 will allow the compression springs 94 to move the chamfered lower edge 97 past the spherical balls 92, thereby forcing them radially inwardly and into locking engagement with spherical recesses 81 in the first wall sections 80. This locks the backing disc 77 and attached rotary finishing tool 98 against axial displacement from the hub. Simultaneously, the web section end faces 90 engage the edge faces 83 of the first wall sections 80 to provide the necessary rotary driving engagement.

Figure 12:
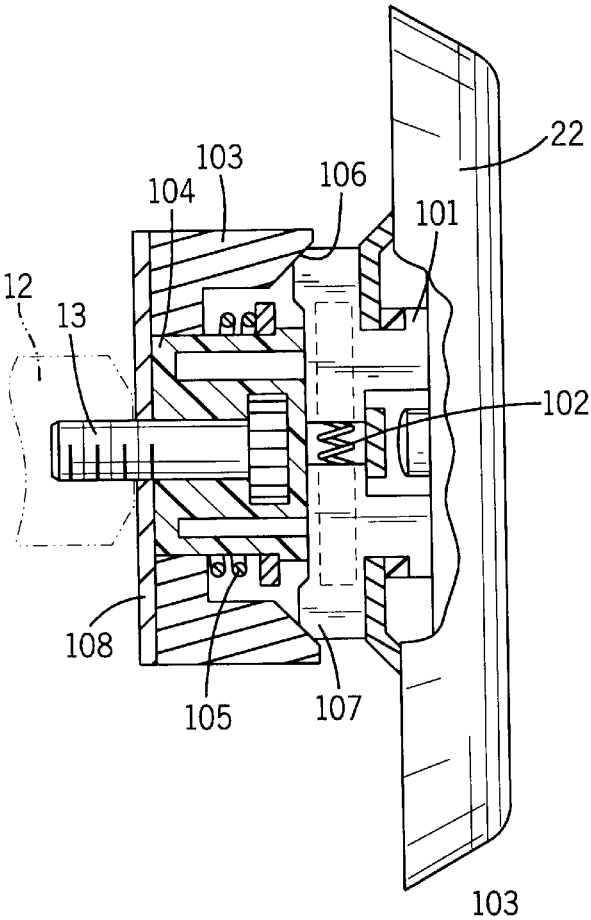
FIGS. 12 and 13 are sectional views showing a variation in the embodiment of FIGS. 3 and 4.
Figure 13:
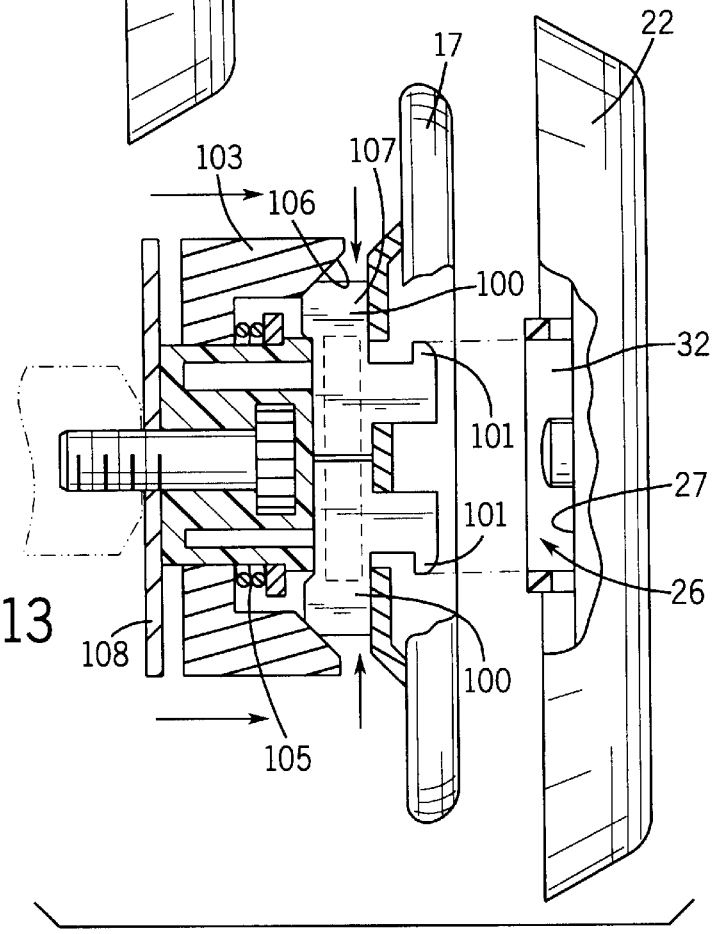

FIGS. 12 and 13 show a variation of connection assembly 21 of the preferred embodiment of FIGS. 3 and 4. In the embodiments of FIGS. 12 and 13, opposed locking slides 100 which carry locking projections 101 are forced together against the bias of compression spring 102 by an operating collar 103 surrounding the drive hub 104. The collar 103 is slidable axially along the hub against the opposing bias of a return spring 105. The lower edge of the operating collar 103 is provided with a chamfer 106 that engages the buttons 107 on the locking slides 100 to cause unlocking sliding movement of the locking projections 101, as shown in FIG. 13 and in a manner similar to operating of the previously described preferred embodiment. When the locking projections 101 are aligned with the locking openings 34 in the sleeve 32 extending from the backing disc 27, release of the operating collar 103 permits the compression spring 102 to move the locking projections into locking engagement in the locking openings 34. The operating collar 103 is moved axially upwardly by return spring 105 into engagement with retaining plate 108.

I claim:

1. An assembly for demountably attaching a rotary finishing tool to the rotary drive spindle of a power tool, said assembly comprising: a backing disc having a rear face and a generally planar front face to which is attached the rotary finishing tool; a drive hub attached to the drive spindle for rotation therewith, said hub having an annular backing plate defining a front mounting face; and, a connector subassembly including a first connector piece on the rear face of the backing disc and a second connector piece on the front face of the backing plate, said connector pieces having complementary positive locking surfaces and complementary driving surfaces which respectively interengage in response to linear coaxial movement along their rotational axes of the backing disc into engagement with the backing plate;

wherein said first connector piece comprises a sleeve forming an integral unitary extension of said backing disc and having its center axis coaxial with said backing disc and a plurality of oppositely disposed locking openings in said sleeve, and wherein said second connector piece comprises a plurality of oppositely disposed locking projections resiliently biased into said locking openings and manually retractable against said resilient bias from said locking openings; and, wherein said sleeve is annular in shape and further comprising a pair of diametrically opposite driving slots in said sleeve positioned circumferentially spaced from said locking openings, said second connector piece comprising a pair of diametrically opposite driving projections circumferentially positioned to lie in and engage said driving slots when said locking projections are aligned with said locking openings.

2. An assembly for demountably attaching a rotary finishing tool to the rotary drive spindle of a power tool, said assembly comprising: a backing disc having a rear face and a generally planar front face to which is attached the rotary finishing tool; a drive hub attached to the drive spindle for rotation therewith, said hub having an annular backing plate defining a front mounting face; and, a connector subassembly including a first connector piece on the rear face of the backing disc and a second connector piece on the front face of the backing plate said connector pieces having complementary positive locking surfaces and complementary driving surfaces which respectively interengage in response to linear coaxial movement along their rotational axes of the backing disc into engagement with the backing plate;

wherein said first connector piece comprises a sleeve forming an integral unitary extension of said backing disc and having its center as coaxial with said backing disc and a plurality of oppositely disposed locking openings in said sleeve, and wherein said second connector piece comprises a plurality of oppositely disposed locking projections resiliently biased into said locking openings and manually retractable against said resilient bias from said locking openings; and, wherein said sleeve is non-circular in shape, and said second connector piece comprises a frame piece having a non-circular shape dimensioned to fit within said sleeve, said sleeve and said frame piece having abutting surfaces comprising said driving surfaces.

3. An assembly for demountably attaching a rotary finishing tool to the rotary drive spindle of a power tool, said assembly comprising: a backing disc having a rear face and a generally planar front face to which is attached the rotary finishing tool; a drive hub attached to the drive spindle for rotation therewith, said hub having an annular backing plate defining a front mounting face; and, a connector subassembly including a first connector piece on the rear face of the backing disc and a second connector piece on the front face of the backing plate, said connector pieces having complementary positive locking surfaces and complementary driving surfaces which respectively interengage in response to linear coaxial movement along their rotational axes of the backing disc into engagement with the backing plate;

wherein said first connector piece comprises a sleeve forming an integral unitary extension of said backing disc and having its center axis coaxial with said backing disc and a plurality of oppositely disposed locking openings in said sleeve, and wherein said second connector piece comprises a plurality of oppositely disposed locking projections resiliently biased into said locking openings and manually retractable against said resilient bias from said locking openings; and, wherein said sleeve comprises a plurality of circumferentially spaced cylindrical first wall sections having inner and outer wall faces, each first wall section having a locking opening in one wall face and a first edge face between said wall faces, and said second connector piece comprises a plurality of cylindrical second wall sections adapted to coaxially receive said first wall section, each second wall section including an opposing wall face carrying one of said locking projections and a second edge face providing with said first edge face said driving surfaces.

4. The assembly as set forth in claim 3 wherein said locking openings comprise recesses and said locking projections comprise complementary spherical balls.

5. The assembly is set forth in claim 4 wherein said recesses are formed in the outer wall faces of said first wall sections and said spherical balls are mounted in retaining holes in said second wall sections for radial movement into locking engagement with said recesses.

6. An assembly for demountably attaching a rotary finishing tool to the rotary drive spindle of a power tool, said assembly comprising:

a drive hub adapted for driven connection to the drive spindle, said hub including an annular backing plate defining a front mounting face;

a backing disc having a rear face and a front face to which is attached the rotary finishing tool;

a connector assembly including a first connector piece on the rear face of the backing disc and a second connector piece on the front face of the backing plate, said connector pieces having complementary driving surfaces and complementary locking surfaces which respectively interengage in response to linear movement along their rotational axes of the backing disc into engagement with the backing plate and relative radial movement between said locking surfaces with respect to said axes; and, wherein said backing disc has a circular outer peripheral edge, said backing plate has an annular ring of a cushioning material attached to its outer peripheral edge, said cushioning ring having an inner peripheral edge defining with said backing plate an annular recess dimensional to receive said backing disc.

7. The assembly as set forth in claim 6 wherein said rotary finishing tool comprises a flexible circular disc having a generally flat rear face attached to the front face of said backing disc and extending radially outwardly into contact with said cushioning ring.

8. The assembly as set forth in claim 7 wherein said finishing tool is permanently attached to the backing disc.

9. The assembly as set forth in claim 7 wherein the finishing tool is demountably attached to the backing disc.

* * * * *